US005135542A

United States Patent [19]

Sasakura et al.

[11] Patent Number: 5,135,542

[45] Date of Patent: Aug. 4, 1992

[54] METHOD FOR FINISHING A CELLULOSIC FABRIC: TREATMENT WITH PHOSPORUS AMIDE COMPOUND

[75] Inventors: Tadao Sasakura, Saitama; Yasuyuki Anasako, Itami, both of Japan

[73] Assignee: Nitto Boseki Co., Ltd., Fukushima, Japan

[21] Appl. No.: 495,854

[22] Filed: Mar. 19, 1990

[30] Foreign Application Priority Data

Mar. 29, 1989 [JP] Japan ..... 1-75063

[51] Int. Cl.[5] ..... D06M 11/51; D06M 13/44; D06M 101/06

[52] U.S. Cl. ..... 8/194; 8/115.51; 8/116.1; 8/127.1; 8/196

[58] Field of Search ..... 8/194, 127.1

[56] References Cited

U.S. PATENT DOCUMENTS

| | | | |
|---|---|---|---|
| 2,661,264 | 12/1953 | Malowan | 8/120 |
| 2,782,133 | 2/1957 | Vallette | 106/18.16 |
| 3,068,060 | 12/1962 | Emmons et al. | 8/194 |
| 4,673,598 | 6/1987 | Itoh et al. | 427/412 |
| 4,795,674 | 1/1989 | Sasakura et al. | 428/254 |
| 5,019,281 | 5/1991 | Singer et al. | 252/8.8 |

FOREIGN PATENT DOCUMENTS

| | | |
|---|---|---|
| 63-303181 | 12/1988 | Japan . |
| 2-084562 | 3/1990 | Japan . |
| 2-084563 | 3/1990 | Japan . |

*Primary Examiner*—A. Lionel Clingman
*Attorney, Agent, or Firm*—Darby & Darby

[57] ABSTRACT

A cellulosic fabric which causes no injury by chlorine and has superior shrinkage resistance can be obtained by the finishing method of the present invention which comprises applying an aqueous solution of a phosphorus amide compound to a cellulosic fabric, drying the fabric applied with the solution of phosphorus amide compound, then heat treating the fabric, and thereafter treating the fabric with an aqueous solution an acid.

9 Claims, No Drawings

METHOD FOR FINISHING A CELLULOSIC FABRIC: TREATMENT WITH PHOSPORUS AMIDE COMPOUND

BACKGROUND OF THE INVENTION

The present invention relates to a method for finishing a cellulosic fabric.

Morris et al have disclosed a technique for improvement of crease recovery and impartment of flameproofness by using phosphoric acid triamide and derivatives of phosphoric acid triamide whose amido group is substituted with chloromethyl or alkyl amine in "Tex. Res. J.", Vol. 44, Pages 700–707 (1974). Furthermore, U.S. Pat. No. 2,782,133 has disclosed flameproofing of cellulosic materials, especially cellulosic fabrics by amidophosphazene compounds and results of the flameproofing. In both of these methods, the finished articles suffer injury caused by chlorine. On the other hand, finishing agents such as aminoplast resin have been sold as finishing agents for inhibiting shrinkage which occurs after repeated washing of cellulosic fabrics. However, fabrics finished with such finishing agents liberate formaldehyde while wearing them, which sometimes cause skin injury. Recently, non-formaldehyde resin has been sold to avoid the skin injury, but the effect to inhibit shrink after repeated washing is low. Thus, there has not yet been attained an excellent finishing method which can afford cellulosic fabrics which are of non-formaldehyde type, have soft hand, show little shrinkage after repeated washing and are free from injury with chlorine.

SUMMARY OF THE INVENTION

The object of the present invention is to provide a method for finishing a cellulosic fabric which is free from the above-mentioned problems and is of non-formaldehyde type and which can give soft hand, causes little shrinkage after repeated washing and causes no injury with chlorine.

As a result of intensive research conducted by the inventors in an attempt to attain the above object, it has been found that the object can be attained by the method comprising applying mainly aqueous solution of a phosphorus amide to a cellulosic fabric and then heat treating the fabric, characterized in that the fabric is treated with an aqueous solution of an acid after the heat treatment. The present invention is based on this finding.

DESCRIPTION OF THE INVENTION

Amidophosphazene compounds as one example of phosphorus amide compounds include cyclic amidophosphazene compounds represented by the formula (1):

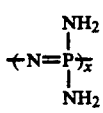

(1)

(wherein x is an integer of 3 or more), and linear amidophosphazene compounds represented by the formula (2) or (3):

$$P_mN_m(NH_2)_{2m} \quad (2)$$

$$P_nN_{n-1}(NH_2)_{2n+3} \quad (3)$$

(wherein m is a positive integer and n is a positive integer of 2 or more).

The amidophosphazene compounds further include those of the above formulas (1), (2) and (3) where a part of the amido groups are substituted with an chloro group, a hydroxyl group by hydrolysis, an alkoxy groups such as methoxy group and ethoxy group, a phenoxy group, a mono-lower alkylamino group, a di-lower alkylamino group or the like.

As specific examples of the amidophosphazene compounds, mention may be made of AA-1000AGB-005, AA-1000AGC-403, AA-1000AGB-0345, AA-1000AGJ-006, AA-1000AGJ-007, and AA-1000AGJ-008 (trademarks for amidophosphazene compounds manufactured by Nippon Soda Co., Ltd.).

Finishing agents mainly composed of aqueous solution of aged amidophosphazene compound are disclosed in Japanese Patent Application No. 63-252328 and these finishing agents may also be used in the present invention.

Phosphoric acid amide compounds as another example of the phosphorus amide compounds include at least one of phosphoric acid triamide ($OP(NH_2)_3$), phosphoric acid triamide condensates and amido substituted derivatives of these phosphoric acid triamide and condensate whose amido group is substituted with other substituent. Examples of the phosphoric acid triamide condensates include imido diphosphoric acid tetramide [$NH(PO)_2(NH_2)_4$] which is a condensate of two molecules of phosphoric acid triamide with release of one molecule of $NH_3$, diimido triphosphoric acid pentaamide [$(NH)_2(PO_3)(NH_2)_5$] which is a condensate of three molecules of phosphoric acid triamide with release of two molecules of $NH_3$, and similar condensates of four molecules, five molecules and six molecules of phosphoric acid triamide and the like.

The amido substituted derivatives include, for example, phosphoric acid triamide and phosphoric acid triamide condensate in which a part of amido groups have been substituted with $—OCH_3$, $—OC_2H_5$, $—OC_3H_7$, $—OC_4H_9$,

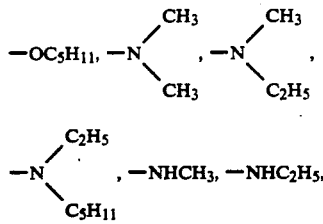

—$ONH_4$, or the like.

The amido substituted derivatives further include those in which a small amount of unreacted —Cl remains or the remaining —Cl group is converted to OH by hydrolysis.

In preparation of the above phosphoric acid amide compounds, ammonium chloride ($NH_4Cl$) is produced as a by-product and the phosphoric acid amide compounds may contain this ammonium chloride in the present invention.

Furthermore, finishing agents mainly composed of aqueous solution of aged phosphoric acid amide compound are disclosed in Japanese Patent Application No. 63-252327 and these finishing agents may also be used in the present invention.

According to the present invention, a finishing agent mainly composed of aqueous solution of abovementioned phosphorus amide compounds (hereinafter referred to as merely "finishing agent") is applied to a fabric and in this case, the finishing agent alone may be used or the following auxiliary components may be added thereto: acidic catalysts such as diammonium hydrogenphosphate, ammonium chloride, organic amine hydrochloride, zinc chloride, magnesium chloride, zinc nitrate, zinc borofluoride, hydrochloric acid and phosphoric acid, and small amounts of conventionally used resin treating agent, softener, penetrating agent, water repellant and/or cellulose crosslinking agent.

Application of the finishing agent to fabric can be performed by immersing the fabric in the aqueous solution and then taking out with or without squeezing by roll or mangle or by spraying or coating the solution onto the fabric.

Application amount of the finishing agent to fabric is preferably such that 2-7% by weight of the effective component are applied to the fabric after drying. If the application amount is small, effect to inhibit shrinking is small and if it is large, tenacity may decrease for some materials.

Base materials which are fiber substrates of the fabrics according to the present invention is cellulosic fibers such as, for example, viscose rayon filaments, viscose rayon staples, high-tenacity viscose rayon filaments, high-tenacity viscose rayon staples, polynosics, cupraammonium filaments, cupraammonium staples, cotton, ramie and linen. Further, the above base material may be mixed with a small amount of fiber other than the base material, for example, organic synthetic fibers such as polyamide, polyester, polyacrylonitrile, polypropylene and spandex and inorganic synthetic fibers such as glass fiber, carbon fiber and silicon carbide fiber. The fabric may be in any forms of woven fabric, knitted fabric, nonwoven fabric, resin-treated fabric, sewn fabric and the like.

After application of finishing agent to fabric, the fabric is subjected to heat treatment. This heat treatment may be carried out using any heat sources such as hot air, infrared rays, microwave, and steam. The heat treatment can be carried out once or twice or more. Heat treating temperature is preferably 50°-190° C. and heat treating time is preferably 1-30 minutes. Suitable temperature and time can be chosen so that the fabric undergoes no damages. The finishing agent is made sparingly soluble in water by the heat treatment and combines with the fabric. After the heat treatment, the fabric is treated with aqueous solution of acid.

As examples of the acid, mention may be made of inorganic acids such as orthophosphoric acid, pyrophosphoric acid, metaphosphoric acid, sulfuric acid, thiosulfuric acid, sulfurous acid, hydrochloric acid, boric acid, nitric acid, hydrogen sulfide, and silicic acid and organic acids such as formic acid, acetic acid, succinic acid, benzoic acid, oxalic acid, sebacic acid, maleic acid and salicylic acid.

Concentration of the acid is preferably 0.5-10 g/l. If the concentration is too low, longer treating time is required and this is economically not preferred. If it is too high, fabric may be damaged and care must be taken. Treating temperature is preferably 50°-80° C. If the temperature is too low, longer treating time is required and this is economically not preferred. If it is too high, burden of energy is great and this is not preferred. Treating time is preferably 5-20 minutes.

After treating with aqueous solution of acid, the fabric is preferably subjected to washing with warm water or the like to remove acid component in the fabric.

Fabric after finished by the method of the present invention contains preferably 0.3-2.0% by weight of phosphorus in the finishing agent of aqueous solution which combines with the fabric and preferably 0.68% by weight or less of nitrogen based on the weight of the finished fabric. If amount of phosphorus in the finishing agent combined with the fabric is too small, the effect to inhibit shrinking is less and if it is too large, tenacity may decrease for some materials. If content of nitrogen is too much, inhibition of injury caused by chlorine is sometimes not sufficient.

Methods for measurement of phosphorus content (% by weight), amount of free formaldehyde, shrink after washing of 45 times, degree of injury caused by chlorine and nitrogen content (% by weight) are as follows:

(1) Measurement of phosphorus content (% by weight):

The phosphorus content (% by weight) in fabric is measured by the sulfuric acid decomposition-colorimetric method explained below.

Reagents:

1. Sulfuric acid for accurate analysis (special grade, 98%)
2. 60% Perchloric acid
3. Ammonium molybdate solution: This is prepared by dissolving 17.7 g of ammonium molybdate (first class grade) in water to obtain 500 ml of the solution.
4. Ammonium metavanadate solution: This is prepared by dissolving 0.6 g of ammonium metavanadate (first class grade) in water, adding thereto 100 ml of 60% perchloric acid and diluting with water to 500 ml.

Measuring apparatuses:

Chemical balance, 50 ml Kjeldahl flask, 10 ml pipette, 5 ml pipette, Kjeldahl heat decomposition stand, 25 ml measuring flask, 50 ml measuring flask, 50 ml measuring cylinder, 500 ml measuring flask, 100 ml measuring cylinder, zeolite, spectrophotometer.

Procedure:

1. Decomposition treatment of sample:

200-300 mg of an oven-dried sample is accurately weighed by a chemical balance and taken in a 50 ml Kjeldahl flask. Thereto are added 5 ml of water, 5 ml of sulfuric acid and several particles of zeolite (made of glass) and the flask is set on a Kjeldahl heat decomposition stand and the sample is subjected to heat decomposition. When the sample is carbonized and dissolves in sulfuric acid to turn brown (about 30 minutes after beginning of heating), heating is discontinued, followed by leaving it for 5 minutes for cooling. Then, 3 drops of 60% perchloric acid are added to the sample and heat decomposition is performed again. The operation of heat decomposition—cooling—addition of perchloric acid is repeated until the decomposition liquid becomes colorless and transparent to perform complete decomposition. Then, the decomposition liquid is cooled to room temperature and is washed with water in a 25 ml measuring flask to dilute until the content reaches scale mark.

2. Measurement:

Depending on estimated phosphorus content, the decomposition liquid is weighed in a 50 ml measuring flask and 30 ml of water is added thereto. Thereafter, 5 ml of ammonium molybdate and 5 ml of ammonium metavanadate are added thereto and the content is diluted with water until it reaches scale mark. Simultaneously, a blank test is conducted in the similar manner. After leaving the sample liquid for 30 minutes, absorbance at 400 nm is measured using the blank sample as a control liquid.

| Estimated phosphorus content | Amount of decomposition liquid taken |
|---|---|
| 0.5–15% | 0.5 ml |
| 0.1–3% | 2.5 ml |

3. Calculation:

$$P(\%) = \frac{\frac{25}{\text{Amount of decomposition liquid taken}} \times \frac{50}{1000} \times 11.65 \times \text{Absorbance} \times 100}{\text{Amount of sample taken (mg)}}$$

(11.65 mg/ml = Ab 1.0)

$$= \frac{\frac{125}{\text{Amount of decomposition liquid taken}} \times 11.65 \times \text{Absorbance}}{\text{Amount of sample taken (mg)}}$$

Since phosphorus content in the treated fabric is 3% or less, amount of decomposition liquid of 2.5 ml is applied and calculation is effected as follows:

$$P(\%) = \frac{\text{Absorbance} \times 11.65 \times 50}{\text{Amount of sample taken (mg)}}$$

(2) Measurement of free formaldehyde:

Measurement is conducted in accordance with JIS L 1096-1979, paragraph 6.39.1.2, (1) method B-1.

(3) Measurement of shrinkage after washings of 45 times:

(a) Collection of sample and preparation of specimen:

A specimen of 40×40 cm is prepared by the method of collection of sample and preparation of specimen mentioned in JIS L-1042-1983: paragraph 7.

(b) Washing:

Washing is carried out in the following manner in accordance with the test method for washing with water specified in the Notice No. 11 of the Fire Defence Board on Jun. 1, 1973 "Standard for washing resistance in connection with flameproofness" (referred to as "Notice No. 11" hereinafter).

(i) Washing is carried out continuously for 75 minutes with liquid of 60° C. According to the method of Notice No. 11, washing time is 15 minutes, but here this is 15 minutes×5 (times)=75 minutes.

Other washing conditions than the washing time are the same as in Notice No. 11. Powder soap (one specified in JIS K3303) is used as detergent in an amount of 1 g for 1 liter of water.

(ii) The washing method of (i) (supply of water of 60° C.→introduction of detergent→introduction of specimen→washing with liquid of 60° C. for 75 minutes→discharge of water·supply of water·rinsing with water of 40° C.×3 times→discharge of water→dehydration for 2 minutes→drying at 60° C.) is repeated 9 times. Since the washing test of (i) is repetition of 5 times of washing, the repetition of 9 times of the method (i) means repetition of totally 45 times.

(c) Measurement:

Measurement is conducted after the washing in accordance with the method mentioned in JIS L-1042-1983: paragraph 9.

(d) Calculation:

Calculation is carried out by the method mentioned in JIS L-1042-1083: paragraph 10. That is, average value of length of three lines in lengthwise and widthwise direction, respectively is obtained and shrink is calculated by the following formula and expressed by average value of three times in lengthwise and widthwise directions, respectively.

$$\text{Progressive shrinkage (\%)} = \frac{L - L'}{L} \times 100$$

L: Length before washing (mm)

L': Length after washing (mm)

(4) Measurement of injury caused by chlorine:

Measurement was conducted according to chlorine injuring test method of JIS L1041-1983: 5,4.

(5) Measurement of nitrogen content:

Measuring apparatus: Apparatus manufactured by Yanagimoto Seisakusho Co.

Measuring method: By CHN KODA MT-3.

EXAMPLE 1

Crude phosphoric acid amide compound (Lot No. HL-302 manufactured by Nippon Soda Co., Ltd.; phosphoric acid amide compound: about 37% and ammonium chloride: about 63%) was dissolved in 0.5% aqueous ammonia solution to obtain an aqueous solution of crude phosphoric acid amide of 400 g/l in concentration. This solution was aged at 20° C. for 37 hours and diluted threefold. A cotton knitted fabric (40s//, 26"×22GG, basis weight: about 188 g/m$^2$, Kanoko) dyed with a fluorescent dye was immersed in said diluted solution and squeezed by a mangle to obtain a pick up of 90%. Then, the fabric was dried and thereafter was heat treated (cured) at 150° C. for 1.5 minute. Then, the fabric was treated with aqueous formic acid solution of 0.5 g/l at 80° C. for 10 minutes, then washed with warm water and dried. Properties of the fabric obtained according to the present invention are shown in Table 1.

COMPARATIVE EXAMPLE 1

Procedure of Example 1 was repeated except that the treatment with aqueous formic acid solution was omitted. Properties of the resulting fabric are shown in Table 1.

EXAMPLE 2

Crude phosphoric acid amide compound (Lot No. HG-010 manufactured by Nippon Soda Co., Ltd.; phosphoric acid amide compound: about 37% and ammonium chloride: about 63%) was dissolved in water to obtain an aqueous solution of 120 g/l. A fabric dyed with a fluorescent dye comprising 100% of polynosics and having a basis weight of about 65 g/m$^2$ was immersed in said aqueous solution and squeezed by a mangle to obtain a pick up of 105%. Then, the fabric was dried and thereafter was heat treated at 150° C. for 2 minutes. Then, the fabric was treated with aqueous solution of orthophosphoric acid of 10 g/l at 70° C. for 10 minutes, then washed with warm water and dried. Properties of the fabric obtained according to the present invention are shown in Table 1. (No damage of the fabric by the treatment with orthophosphoric acid was recognized.).

COMPARATIVE EXAMPLE 2

Procedure of Example 2 was repeated except that the treatment with aqueous orthophosphoric acid solution was omitted. Properties of the resulting fabric are shown in Table 1.

EXAMPLE 3

An aqueous solution containing 120 g/l of a crude amidophosphazene compound (AA-3000L Lot No. GL-012 manufactured by Nippon Soda Co., Ltd.; amidophosphazene compound; about 42% and ammonium chloride; about 58%) was prepared and a cotton knitted fabric [$42^{s'}$ (cotton count)/2, 26"×24GG, basis weight: about 180 g/m$^2$, Kanoko] dyed with a fluorescent dye was immersed in said aqueous solution and squeezed by a mangle to obtain a pick up of 95%. Then, the fabric was dried and thereafter was heat treated at 155° C. for 1.5 minute. Then, the fabric was treated with aqueous sulfuric acid solution of 1 g/l at 60° C. for 15 minutes, then washed with warm water and dried. Properties of the resulting fabric of the present invention are shown in Table 1.

COMPARATIVE EXAMPLE 3

Procedure of Example 3 was repeated except that the treatment with aqueous sulfuric acid solution was omitted. Properties of the resulting fabric are shown in Table 1.

COMPARATIVE EXAMPLE 4

The same cotton knitted fabric as used in Example 3 was immersed in an aqueous solution containing 90 g/l of commercially available non-formalin type resin finishing agent BECKAMIN NF-5 (manufactured by Dainippon Ink & Chemicals Inc.) and 30 g/l of Catalyst GT (manufactured by Dainippon Ink & Chemicals Inc.) and then was squeezed by a mangle to obtain a pick up of 95%. After drying, the fabric was heat treated at 155° C. for 2 minutes. Properties of the resulting fabric are shown in Table 1.

TABLE 1

| | Free formaldehyde (μg/g) | Phosphorus content (% by weight) | Nitrogen content (% by weight) | Shrinkage after washing of 45 times (%) | | Injury by chlorine (grade) |
|---|---|---|---|---|---|---|
| | | | | Longi-tudinal | Transverse | |
| Example 1 | 1 | 0.9 | 0.65 | 5.5 | 5.0 | 4 |
| Example 2 | 2 | 1.1 | 0.50 | 0.5 | 0 | 4–5 |
| Example 3 | 1 | 1.0 | 0.41 | 5.0 | 6.0 | 4 |
| Comparative Example 1 | 1 | 1.0 | 0.81 | 5.0 | 5.5 | 2–3 |
| Comparative Example 2 | 1 | 1.2 | 0.75 | 1.0 | 0.5 | 3 |
| Comparative Example 3 | 2 | 1.0 | 0.74 | 5.5 | 6.0 | 2 |
| Comparative Example 4 | 3 | — | — | 13.0 | 5.5 | 4 |

Free nitrogen-containing compounds or groups which easily adsorb chlorine in fabrics are removed by the treatment with aqueous solution of acid according to the present invention and on the other hand, phosphorus amide compounds which chemically bond to the cellulose of the fabric are not removed by the treatment with aqueous solution of acid of the present invention. Therefore, amount of chlorine adsorbed to the fabric is reduced and thus injury caused by chlorine is diminished and effect to inhibit shrinking can be favorably retained. As is clear from Table 1, reduction of phosphorus content in the fabric is very small, namely 0–0.1% by weight while reduction of nitrogen content is great, namely, 0.16–0.33% by weight. As a result, injury caused by chlorine can be improved with retaining the favorably small shrinkage. Furthermore, as is clear from the above Examples and Comparative Examples, the samples of the present invention are considerably superior in injury caused by chlorine to the comparative samples which were not subjected to treatment with aqueous solution with acid after heat treatment, although there was seen no special difference in shrink after washing of 45 times. Thus, the samples of the present invention are superior to comparative samples. Furthermore, when the method of the present invention is compared with the conventional method using non-formaldehyde type resin, it is clear that there is no difference in injury caused by chlorine, but there is the remarkable difference in shrinkage after washing of 45 times and thus the present invention is superior.

As explained above, the fabrics treated according to the present invention are improved in various properties and besides the treatment is non-formaldehyde type and the fabric is soft in hand and hence the fabrics are used as cloths such as those for infants and pajamas, lingeries, bed sheets, blouses and dress shirts which directly contact with skin.

What is claimed is

1. A method for finishing a cellulosic fabric which comprises the steps of:

(a) applying an aqueous solution of a amidophosphazene or phosphoric acid amide compound to a cellulosic fabric;

(b) drying the exposed fabric;

(c) heat treating the dried fabric at 50°–190° C. for 1–30 minutes; and (d) treating the heat treated fabric with an aqueous solution of an organic or inorganic acid.

2. A method according to claim 1, wherein the amidophosphazene compound is a cyclic amidophosphazene compound represented by the formula (1):

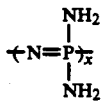

(1)

wherein x is an integer of 3 or more and a part of amido groups may be substituted with an chloro group, a hydroxyl group, an alkoxy group, a phenoxy group, a mono-lower alkylamino group or a di-lower alkylamino group, or a linear amidophosphazene compound represented by the following formula (2) or (3):

$$P_mN_m(NH_2)_{2m} \quad (2)$$

$$P_nN_{n-1}(NH_2)_{2n+3} \quad (3)$$

wherein m is a positive integer and n is a positive integer of 2 or more and a part of amido group may be substituted with an chloro group, a hydroxyl group, an alkoxy group, a phenoxy group, a mono-lower alkylamino group or a di-lower alkylamino group.

3. A method according to claim 1, wherein the phosphoric acid amide compound is phosphoric acid triamide, a phosphoric acid triamide condensate or their amido substituted derivatives thereof.

4. A method according to claim 1, wherein step (a) is carried out by immersing the fabric in the aqueous solution or spraying or coating the aqueous solution onto the fabric.

5. A method according to claim 1, wherein amount of the amidophosphazene or phosphoric acid amide compound applied to the fabric is 2–7% by weight based on the weight of the fabric.

6. A method according to claim 1, wherein the inorganic acid selected from the group consisting of orthophosphoric acid, pyrophosphoric acid, metaphosphoric acid, sulfuric acid, thiosulfuric acid, sulfurous acid, hydrochloric acid, boric acid, nitric acid, hydrogen sulfide and silicic acid.

7. A method according to claim 1, wherein the organic acid selected from the group consisting of formic acid, acetic acid, succinic acid, benzoic acid, oxalic acid, sebacic acid, maleic acid and salicyclic acid.

8. A method according to claim 1, wherein concentration of the acid in the aqueous solution is 0.5–10 g/l.

9. A method according to claim 1, wherein step (d) is carried out at 50°–80° C. for 5–20 minutes.

* * * * *